United States Patent [19]

Vallance

[11] 3,930,979

[45] Jan. 6, 1976

[54] POROUS DIAPHRAGMS

[75] Inventor: Christopher Vallance, Runcorn, England

[73] Assignee: Imperial Chemical Industries Limited, London, England

[22] Filed: June 27, 1974

[21] Appl. No.: 483,907

[30] Foreign Application Priority Data

July 18, 1973 United Kingdom ..... 34167/73

[52] U.S. Cl. ..... 204/252; 204/151; 204/296; 204/301

[51] Int. Cl.[2] ..... C25C 2/00

[58] Field of Search..... 204/180 R, 296, 151, 301, 204/130, 252, 257

[56] References Cited

UNITED STATES PATENTS

| | | | |
|---|---|---|---|
| 2,542,527 | 2/1951 | Honey et al. | 18/48 |
| 3,257,334 | 6/1966 | Chen et al. | 204/296 X |
| 3,282,875 | 11/1966 | Connolly et al. | 204/296 X |
| 3,718,561 | 2/1973 | Jacob | 204/180 R |

FOREIGN PATENTS OR APPLICATIONS

| | | | |
|---|---|---|---|
| 1,124,362 | 8/1968 | United Kingdom | 204/283 |
| 1,144,357 | 4/1965 | Germany | 204/296 |
| 1,174,973 | 2/1965 | Germany | 204/296 |
| 2,139,646 | 8/1971 | Germany | 204/296 |

*Primary Examiner*—John H. Mack
*Assistant Examiner*—A. C. Prescott
*Attorney, Agent, or Firm*—Cushman, Darby & Cushman

[57] ABSTRACT

A process for the manufacture of a porous diaphragm of a synthetic material, especially polytetrafluoroethylene, which comprises forming a sheet of the synthetic material in admixture with a solid particulate additive (eg starch) to be removed therefrom, introducing said sheet into a cell, and removing the solid particulate additive from the sheet by treating the sheet in situ in the cell with an acid (eg hydrochloric acid) containing a corrosion inhibitor (eg propargyl alcohol). The porous diaphragms are especially suitable for use in diaphragm cells for the production of chlorine from sodium chloride brine.

20 Claims, No Drawings

POROUS DIAPHRAGMS

This invention relates to the manufacture of porous diaphragms.

More particularly, the invention relates to the manufacture of porous diaphragms based on polytetrafluoroethylene. Such diaphragms are especially suitable for use in cells electrolysing alkali metal chloride solutions.

In the specification of our UK Pat. No. 1,081,046 there is described a method of manufacturing porous diaphragms which comprises forming an aqueous slurry or dispersion of polytetrafluoroethylene and a solid particulate additive such as starch, adding an organic coagulating agent such as acetone to said dispersion and then drying the coagulated dispersion. An organic lubricant such as petroleum ether is then added to the dried coagulated material to serve as a processing aid when the material is being rolled into a sheet. On completion of the rolling operation the starch is removed to give the desired porous diaphragm. The lubricant can also be removed if required.

An improved method of manufacturing porous diaphragms in which the organic lubricant is replaced by water as the lubricant is described in the specification of our copending UK Application No. 5351/72. This method comprises preparing an aqueous slurry or dispersion comprising polytetrafluoroethylene and a solid particulate additive, thickening said aqueous slurry or dispersion to effect agglomeration of the solid particles therein, forming from the thickened slurry or dispersion a dough-like material containing sufficient water to serve as lubricant in a subsequent sheet forming operation, forming a sheet of desired thickness from said dough and removing solid particulate additive from the sheet.

In each of the above methods the solid particulate additives are removed from the diaphragm prior to introducing the diaphragm into the cell. The particulate additives may be removed, for example, by soaking the diaphragm in an acid, preferably a mineral acid eg hydrochloric acid. The diaphragm is then washed with water to remove the acid and assembled, whilst wet, into a cell. It is necessary to keep the diaphragm wet during assembly in order to prevent collapse of the pores and this leads to considerable difficulties in handling since the diaphragm is both extremely wet and extremely slippery (the latter being due to the polytetrafluoroethylene).

Further disadvantages arising from the use of pre-extracted diaphragms, prepared as described above, include the difficulty of ensuring adequate tautness of the wet diaphragm whilst in the cell unit, and the possibility of leakages occurring at the sealing gasket mounted along the wet edges of the diaphragm. We have now found that the above disadvantages and difficulties are obviated or mitigated by the process of the present invention in which the solid particulate additive is removed from the diaphragm in situ in in the cell.

According to the present invention there is provided a process for the manufacture of a porous diaphragm of a synthetic material for use in an electrolytic cell which comprises forming a sheet of the synthetic material in admixture with a solid particulate additive to be removed therefrom, introducing said sheet into an electrolytic cell, and removing solid particulate additive from the sheet by treating the sheet in situ in the cell by treating the sheet with an acid containing a corrosion inhibitor.

The process according to the invention is especially applicable to the manufacture of porous diaphragms based on synthetic organic polymeric materials, for example polyvinylidene fluoride and more particularly polytetrafluoroethylene.

Suitable acids include inorganic acids, especially mineral acids, for example nitric, sulphuric and hydrochloric acids, and organic acids, for example alkanoic acids, especially acetic acid.

In general, it is preferred to use hydrochloric acid in view of its ready availability in electrolytic chlorine plants and its cheapness, for example hydrochloric acid containing 16 to 18% HCl.

Corrosion inhibitors which may be used in the process according to the invention include any additives which are stable in the acid being used and which effectively prevent corrosion of mild steel. Suitable corrosion inhibitors include propargyl alcohol (prop-2-yne-1-ol; $HC \equiv C.CH_2OH$), thiourea and alkali metal thiocyanates (eg potassium thiocyanate), but the use of propargyl alcohol is preferred.

The proportion of corrosion inhibitor, for example propargyl alcohol, is conveniently, in the range 0.01 percent to 5.0 percent by volume, for example 0.1 percent by volume, based on the volume of acid.

The removal of solid particulate matter from the diaphragm may conveniently be carried out at an ambient temperature, although if desired it may be carried out at an elevated temperature, for example 50°to 60°C, without any deleterious effects.

The acid, for example hydrochloric acid, may be used several times (eg 3 or 4 times) without loss of effectiveness.

After treatment, the acid is drained off, the cell is refilled with the working electrolyte (for example sodium chloride brine) and electrolysis is commenced.

The process of the invention is applicable to the removal of a range of solid particulate additives from the diaphragm, for example starch (eg maize starch and/or potato starch), cellulose acetate, cellulose (as described in our copending UK Application No. 34169/73) and water-soluble inorganic bases or carbonates, for example calcium carbonate. It is preferred to use a mineral acid, especially hydrochloric acid, when removing starch, cellulose and water-soluble inorganic bases or carbonates, for example calcium carbonate. The use of acetic acid is preferred when removing cellulose acetate as the additive.

The unextracted diaphragms may conveniently be prepared from aqueous slurries or dispersions of the synthetic material (for example polytetrafluoroethylene) and the solid particulate additive by the methods described in our UK Pat. No. 1,081,046 and in our copending UK application No. 5351/72, referred to above.

When using polytetrafluoroethylene as the synthetic material for example, the preferred particle size of the polytetrafluoroethylene in the aqueous slurry or dispersion is in the range of 0.05 to 1 micron, for example 0.1 to 0.2 micron.

Generally, the additive has a particle size substantially all of which are within the range of 5 to 100 microns. The amount of additive will depend on the permeability desired in the final diaphragm. Thus, the weight ratio of additive to polytetrafluoroethylene may be, for example, from 10:1 to 1:10, preferably from 5:1 to 1:1.

In many cases it is desirable to incorporate other components in the aqueous slurry or dispersion which are not removed when the sheet is subjected to the treatment to remove the particulate additive. Examples of such components include particulate fillers, generally inorganic fillers, for example titanium dioxide which is particularly preferred, barium sulphate, asbestos, (for example amphibole or serpentine asbestos), graphite and alumina. Suitably the filler has a particle size of, for example, less than 10 microns and preferably less than 1 micron. The weight ratio of filler to the synthetic material, for example polytetrafluoroethylene may be for example from 10:1 to 1:10, preferably from 2:1 to 1:2.

The diaphragms produced by the process according to the invention are generally strong enough to be used without any support but for extra strength it may be desirable to incorporate a sheet of a suitable strengthening material, for example, a polymer gauze such as a polypropylene gauze.

The diaphragms thus produced are particularly suitable for use in electrolytic cells for the electrolysis of alkali metal halides, for the production of chlorine and caustic alkalies.

The invention is illustrated but not limited by the following Example in which all parts and percentages are by weight.

EXAMPLE

To 100 parts of an aqueous dispersion of polytetrafluoroethylene containing 60% of the polymer in the form of particles approximately all in the size range 0.15 to 0.2 micron were added 101 parts of water, 60 parts of titanium dioxide of particle size approximately 0.2 micron, 60 parts of maize starch of particle size approximately 13 microns and 120 parts of potato starch of particle size less than 75 microns. The mixture was then stirred with a paddle-mixer for 30 minutes to form a substantially uniform paste. This paste was spread on trays and dried at 24°C for 48 hours to a water content 5.7% by weight. 100 parts of the resultant crumb were mixed with 52 parts of water to form a dough having a viscosity of $4 \times 10^6$ poise. The dough was then spread along the shortest edge of a rectangular piece of card, and calendered on the card between dual, even-speed, calender rolls, set 3 mm apart, into an oblong sheet. After calendering, the oblong sheet was cut, in the direction of calendering, into four equal pieces. These were laid congruently over each other to obtain a four-layered laminate. The card was picked up, rotated 90° in the horizontal plane, and calendered (directed 90° to the original direction of calendering) again through the 3 mm roll separation. This process, the successive cutting into four, stacking, rotating and calendering was repeated until the composition had been rolled a total of five times. The resultant laminate was cut into four, in the direction of calendering, stacked, removed from the card, and calendered, without rotation through 90°, the inter-roll space being reduced by the thickness of the card. After calendering, the laminate was cut, at right angles to the direction of calendering, into four equal pieces, stacked, rotated through 90° and calendered again. This process, cutting at right angles to the direction of calendering, stacking, rotating and calendering was repeated until the composition had been rolled a total of nine times. The resultant essentially rectangular laminate was then passed through the rolls with its largest side directed at 90° to the direction of calendering, and with the inter-roll space slightly reduced, no cutting, stacking or rotating through 90° being involved. This process was repeated through a gradually reduced inter-roll space, the same edge of the laminate being fed to the rolls on each occasion, until the thickness of the laminate was 1.5 mm. A square of 22 × 26 mesh gauze woven of 0.011 inch diameter monofilament polypropylene yarn was placed on the top of the laminate, and rolled into the laminate by calendering through a slightly reduced inter-roll space.

The resultant reinforced sheet was removed from the rolls and assembled in an electrochemical cell. The cell was filled with 18% HCl containing 0.1% propargyl alcohol, and allowed to stand for 24 hours at ambient temperature. The acid was then drained from the cell and replaced with sodium chloride brine. The current was switched on and a head of brine applied across the diaphragm. Flow through the diaphragm was instantaneous. Design flow and normal cell voltage was achieved within 30 minutes. Inspection of the hydrochloric acid drained from the catholytic compartment revealed that corrosion of the cathode had been minimal.

What we claim is:

1. A process for the manufacture of a porous diaphragm of a synthetic material for use in an electrolytic cell which comprises forming a sheet of the synthetic material in admixture with a solid particulate additive to be removed therefrom, introducing said sheet into an electrolytic cell, and removing solid particulate additive from the sheet in situ in the cell by treating the sheet with an acid containing a corrosion inhibitor.

2. A process as claimed in claim 1 wherein the acid is a mineral acid.

3. A process as claimed in claim 2 wherein the acid is nitric, sulphuric or hydrochloric acid.

4. A process as claimed in claim 3 wherein the acid is 16 to 18% by weight hydrochloric acid.

5. A process as claimed in claim 1 wherein the acid is an alkanoic acid.

6. A process as claimed in claim 5 wherein the acid is acetic acid.

7. A process as claimed in claim 1 wherein the corrosion inhibitor is propargyl alcohol.

8. A process as claimed in claim 1 wherein the corrosion inhibitor is thiourea.

9. A process as claimed in claim 1 wherein the corrosion inhibitor is an alkali metal thiocyanate.

10. A process as claimed in claim 9 wherein the corrosion inhibitor is potassium thiocyanate.

11. A process as claimed in claim 1 wherein the proportion of corrosion inhibitor is in the range 0.01 to 5.0 percent by volume based on the volume of acid.

12. A process as claimed in claim 11 wherein the proportion of corrosion inhibitor is 0.1 percent by volume based on the volume of acid.

13. A process as claimed in claim 1, which is carried out at ambient temperature.

14. A process as claimed in claim 1, which is carried out at a temperature in the range 50° to 60°C.

15. A process as claimed in claim 1 wherein the synthetic material is polytetrafluoroethylene.

16. A process as claimed in claim 1 wherein the solid particulate additive is starch, cellulose, cellulose acetate, or a water-insoluble base or carbonate.

17. A process as claimed in claim 16 wherein the removable solid particulate additive is maize starch and/or potato starch or calcium carbonate.

18. An electrolytic cell fitted with a porous diaphragm, which porous diaphragm is produced in accordance with claim 1.

19. An electrolytic cell as claimed in claim 18 for the electrolysis of an alkali metal chloride brine.

20. An electrolytic cell as claimed in claim 18 for the electrolysis of sodium chloride brine.

* * * * *